United States Patent [19]

Gilbert

[11] 3,936,968

[45] Feb. 10, 1976

[54] ADJUSTABLE FRAME

[76] Inventor: Howard E. Gilbert, P.O. Box 294 Deering St., East Setaucket, Long Island, Suffolk County, N.Y. 11733

[22] Filed: July 18, 1973

[21] Appl. No.: 380,505

Related U.S. Application Data

[62] Division of Ser. No. 46,638, June 16, 1970, Pat. No. 3,823,499.

[52] U.S. Cl. ..... 40/155; 248/488; 248/490

[51] Int. Cl.[2] ..... G09F 1/12

[58] Field of Search..... 40/154, 155, 152.1; 248/488, 490

[56] References Cited

UNITED STATES PATENTS

| | | | |
|---|---|---|---|
| 2,776,508 | 1/1957 | Hutson | 40/155 |
| 2,777,232 | 1/1957 | Kulicke et al. | 40/155 |
| 3,060,606 | 10/1962 | Peach | 40/154 |
| 3,451,153 | 6/1969 | Dohanyos | 40/155 |
| 3,465,461 | 9/1969 | Price et al. | 40/155 |
| 3,665,628 | 5/1972 | Dammond | 40/155 |

*Primary Examiner*—Robert W. Michell
*Assistant Examiner*—Wenceslao J. Contreras
*Attorney, Agent, or Firm*—Stephen E. Feldman

[57] ABSTRACT

An adjustable frame comprising corner members, cross braces for connecting said corner members, the cross braces comprising strips which can be cut down or bent back so as to adjust the cross braces to any desired frame size, a plurality of apertures on each of the cross braces performing a double function, the first function being to provide apertures for connecting the brace to diagonally opposite corner member, the second function being to provide means for anchoring a suspension wire to the frame. Two of the corner members include means for adjustably connecting the cross brace thereto so as to assure that the cross brace is tight. Each of the corner members further include stand receiving means to permit the frame to be supported on its end or on its side. The stand is an L-shaped member capable of being selectively inserted in the stand receiving means so as to permit the frame to be weighted down or anchored to the ground. Each of the corner members may include spring biased means so as to readily accommodate and grasp articles of varying thicknesses. The frame is designed so that the spring clips and cross frame braces lie flush or within the confines of the corner members so as to minimize interference in hanging or storing the framed articles. The frame may be designed without cross braces so that pictures and the like may be viewed from both sides of the frame.

3 Claims, 16 Drawing Figures

ADJUSTABLE FRAME

This is a division of application Ser. No. 46,638, filed June 16, 1970, now U.S. Pat. No. 3,823,499.

BACKGROUND OF THE INVENTION

The present invention relates to frames and more particularly, to adjustable frames capable of framing articles of varying dimension. Such frames have many applications such as the framing of pictures, documents, the assembling of sheet material for storage and transportation, etc.

Heretofore, frames have been made which are adjustable to accommodate pictures of varying dimensions. Examples of such structures are illustrated in U.S. Pat. Nos. 2,824,398, 2,810,226, 2,632,971, 208,681 and 2,164,299.

None of the above proposed systems have proved to be commercial due to the complexity of the adjusting mechanism. These complex structures are not only costly, but in addition, interfere with compact storage and hanging. A further limitation in each of these structures is their inability to readily convert to a stand type structure. These structures are further limited in that they will only hold articles of a selected thickness. A further limitation in some of these structure is that the frame portions are not positively locked in palce.

BRIEF DESCRIPTION

The present invention comprises an adjustable frame comprising four corner members interconnected by cross braces.

The cross braces comprise thin plastic strips which can be cut down or bent back so as to adjust the cross braces to any desired frame size. The cross braces are formed with a plurality of apertures so that after the strip is cut down or bent back, an aperture is available for attaching the strip to a headed member provided on each of the corner members. The headed members are selectively positioned on the corner members so as to assure that the brace can be made tight. The apertures in the braces are also utilized to anchor a suspension wire so as to allow the framed articles to be hung, if desired.

The braces lie flush with the corner members so as not to protrude from the back of the frame and thereby interfere in hanging or with compact storage of framed articles.

The frame easily converts to a stand type structure by the incorporation of stand receiving means in each of the corner members. The stand receiving means allows for selective positioning of the frame on its end or on its side. The stand is L-shaped and selectively inserted into the standing means so as to permit the stand to be weighted down or anchored to the ground. The stand may be selectively secured to the corner members so as to support the frame in raised or adjacent positions relative to the ground.

In a still further embodiment of the invention, spring clamps are provided on each of the corner members so as to resiliently grasp the framed articles against the corner members. In a still further embodiment of the invention, the corner members are made of pliable plastic so as to resiliently grasp the article to be framed. In both of these modifications, the spring means is sufficiently resilient to adjust to articles of various thicknesses.

In a still further embodiment of the invention, cross braces extend across both faces of the frame to provide rigid support while in another embodiment the cross braces are eliminated to permit viewing pictures on opposite surfaces of the frame.

DRAWINGS

DETAILED DESCRIPTION

Figure 1:
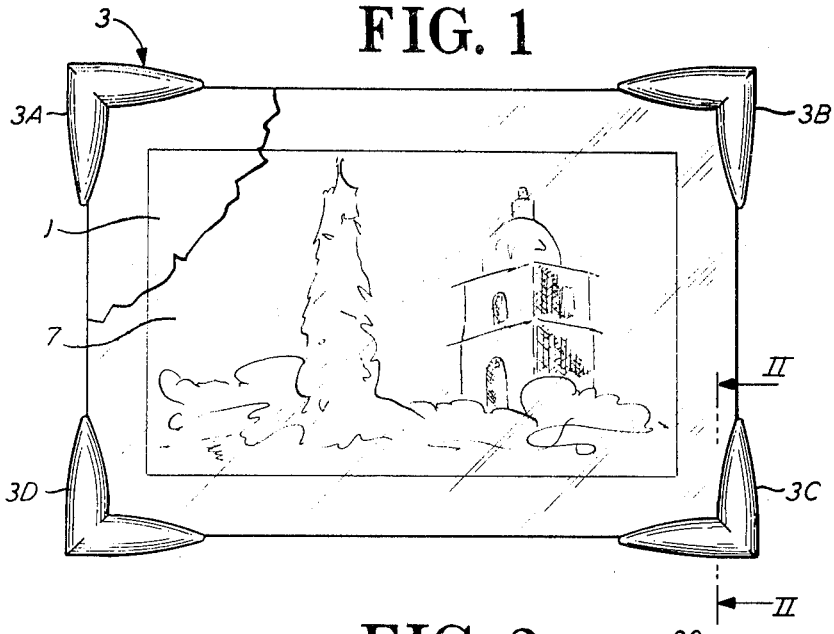
FIG. 1 is a front elevational view of the frame of the present invention mounted on an article.

Referring to FIG. 1, a picture 1 is shown having a frame 3 constructed in accordance with the present invention.

While the present invention will be described and illustrated in connection with a picture or the like, it is to be understood that the frame can be used in connection with various articles which have need for a frame. As an example, the present invention has application in packaging and in transporting sheets of material such as thin metal. It is particularly applicable where the surfaces of the sheet metal have to be protected from marring and in cases where it is desired to prevent thin sheets from creasing. In these applications, protective boards of a dimension equal to the dimension of the sheet metal are placed in contact with opposite surfaces of the metal, and the frame of the present invention is then utilized to hold the assembled sheets together and to offset the assembled sheets from contact with adjacent surfaces.

As shown in FIG. 1, the frame 3 comprises corner members 3A, 3B, 3C and 3D. The corner members may be constructed from any suitable material such as wood, rigid foam, metal and preferably, are formed of plastic.

Figure 2:
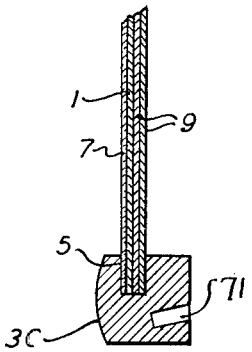
FIG. 2 is a sectional view taken on line II—II of FIG. 1.

Referring to FIG. 2, each corner member is grooved, as shown at 5, to fit about the corners of picture 1. Picture 1 is snugly engaged by the corner members 3A, 3B, 3C and 3D as it is wedged between a glass or transparent plastic sheet 7 and one or more backing pieces 9. The backing piece may comprise cardboard, masonite, or the like.

Figure 3:
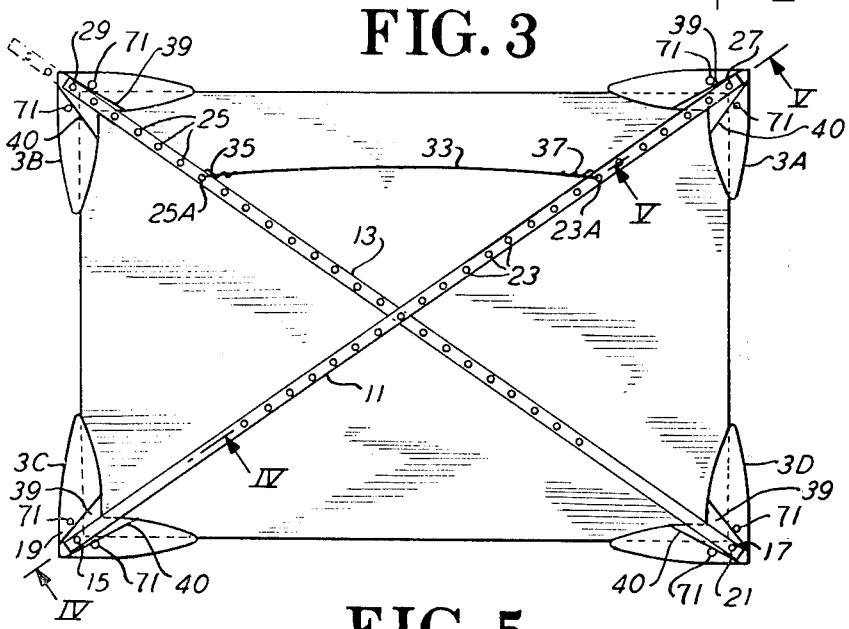
FIG. 3 is a rear elevational view of the frame shown in FIG. 1.

Referring to FIG. 3, a rear view of the frame 3 is shown. The corner members 3A, 3B, 3C and 3D are interconnected and locked to picture 1 by cross braces 11 and 13 which extend diagonally across the back of the picture. The cross braces are made of thin plastic material, such as cellulose butyrates, one thirty-second of an inch thick, which is capable of being bent upon itself or cut by scissors, razor blade, knife or the like, so as to permit the cross braces to be cut down or bent back to a size corresponding to the diagonal dimension of the picture. It is to be understood that the cross braces may be made from any suitable plastic and thickness as long as it is capable of readily binding and/or being cut. The cross braces are initially made extra long to accommodate extra large pictures.

The cross braces 11 and 13 include apertures 15 and 17 at one end for anchoring the braces to corner members 3C and 3D respectively. The braces are connected by snap fitting apertures 15 and 17 (see FIG. 4) over headed pins 19 and 21 integrally formed on the corner members 3C and 3D, respectively.

Each of the cross braces 11 and 13 are also provided with a series of apertures 23 and 25, respectively, so that an aperture is available for attaching the brace to headed pins 27 and 29 releasably secured to corner members 3A and 3B, respectively. After securing the braces by way of apertures 23 and 25, the cross braces are cut down. This method allows extra lengths of the cross braces to serve as a convenient grip while attaching.

Figure 5:
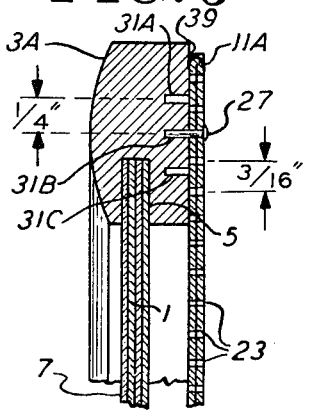
FIG. 5 is a sectional view taken on line V—V of FIG. 3.

Referring to FIG. 5, pin holes 31A, 31B and 31C are provided in corner member 3A for releasably and frictionally receiving pin 27. These holes are spaced apart a predetermined distance, e.g., one-fourth of an inch while apertures 23 are also spaced a predetermined smaller distance, e.g., three-sixteenths of an inch. This arrangement assures that one of the holes 31A. 31B and 31C will lie between one-eighth and one-sixteenth of an inch outwardly from one of the apertures 23. When the pin 27 to be inserted in such outer aperture, the plastic cross brace 11 is then stretched so as to snap over the pin 27. In this manner, the cross brace is made tight. The same arrangement is provided in connecting cross brace 13 to headed pin 29 in corner member 3B.

It is to be understood that apertures 23 and pin holes 30 may be spaced greater or smaller distances depending on the degree to which it is desired to make the cross braces taut.

As hereinbefore described, the cross braces are made extra long so as to accommodate large pictures. Generally, the braces have to be cut down, e.g., by cutting with a scissor the extra length portions shown in broken lines in FIG. 3. In the alternative, the cross braces may be bent back upon themselves as shown in FIG. 5 and as hereinafter more particularly described.

It will be noted that even after the cross braces are cut down, the frame can be made to accommodate pictures of smaller dimension merely by cutting down further on the cross braces. The series of apertures 23 and 25 extend along the cross braces to a sufficient extent so as to allow an adjustment down to a size where the corner members 3A, 3B, 3C and 3D are abutting. If a purchaser desired to frame a larger article, it is only required that he purchase four cross braces of suitable length. In its commercial form, the initial package may include such extra braces.

The cross brace need not be cut down. As shown in FIG. 5, the cross brace 11 is bent back upon itself at 11A with the apertures aligned so as to permit the strip to be snapped over pin 27. This arrangement allows the cross brace to be subsequently used in framing larger as well as smaller pictures.

Referring to FIG. 3, the series of apertures 23 and 25 perform a second function as selected horizontally aligned apertures 23A and 25A in each series are used to anchor suspension wire 33. The wire 33 is simply extended at each of its ends, through apertures 23A and 25A and wrapped about itself as indicated at 35 and 37. The wire 31 is of sufficient length so as to provide slack for hanging the framed pictures.

Figure 4:
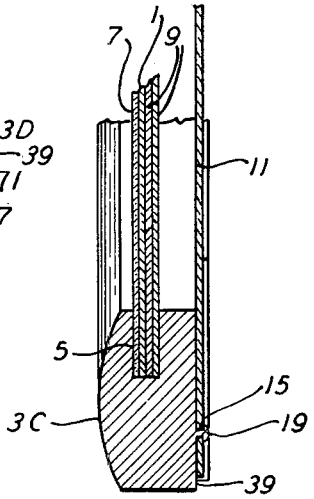
FIG. 4 is a sectional view taken along line IV—IV of FIG. 3.

Referring to FIGS. 3, 4 and 5, each of the corner members 3A, 3B, 3C and 3D include channels 39 for receiving the cross braces 11 and 13 so that the cross braces are flush with the outer surface of the corner members. In this manner, there is a minimal interference in hanging the framed picture. When the frame is used to assemble sheet material, the flush arrangement allows a plurality of framed sheets to be compactly arranged during storage and transportation. The channels 38 include diverging walls 40 so as to accommodate the cross braces in various angular positions within the size adjustment range.

Figure 6:
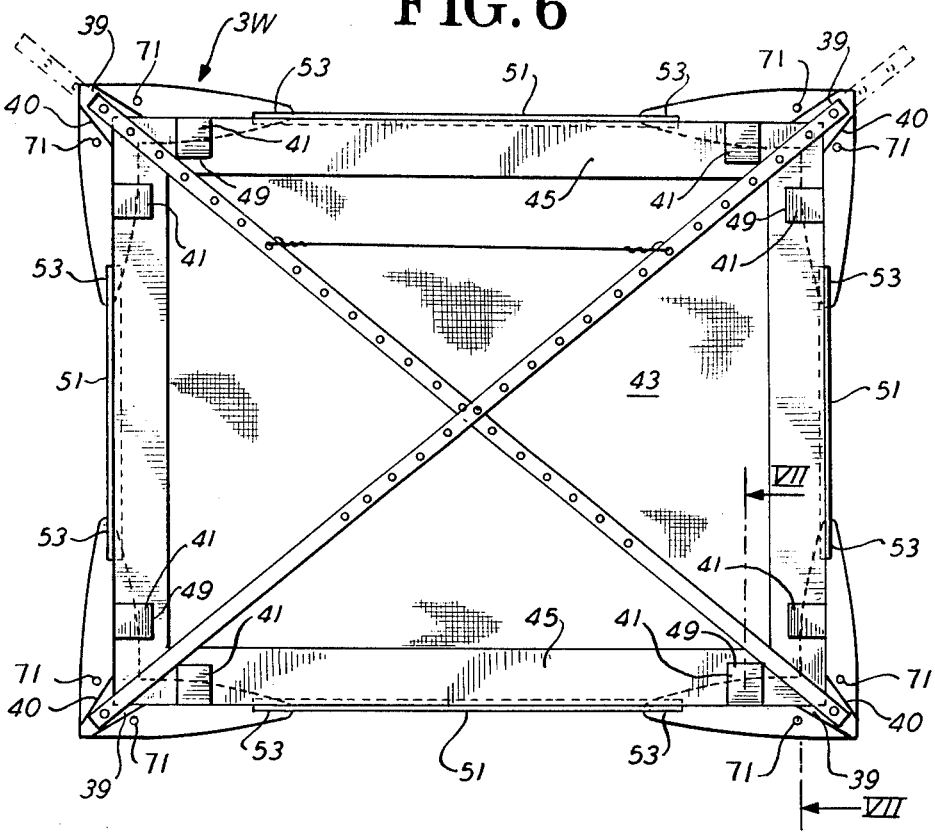
FIG. 6 is a rear elevational view illustrating a modified form of the present invention.

Referring to FIG. 6, a modification of the present invention is shown which is particularly adapted to be used in framing paintings and assembled sheets as hereinbefore described. In this embodiment, the corner members 3W are modified to include clamps 41 securing the corner members to the framed article. The clamps 41 are spring biased and can accommodate framed articles of varying thicknesses.

As shown in FIG. 6, the framed article is a painting comprising a canvass 43 mounted on a rectangular frame 45. Each of the clamps 41 comprise single bend twenty-five one thousanth shim steel plates, cemented or otherwise secured, at one end to a recess 47 in each of the corner members 3W. The other end of the spring clamps bear against the frame 45 as indicated at 49 in FIG. 7.

The spring clamps 41 are mounted so as not to project from the corner members and interfere with hanging or storage. Rather than cementing the clamps 41 to the corner members, the same may be removably connected by, e.g., a conventional cooperating detent and recess arrangement (not shown) on the clamp 41 and in recess 47, respectively. This has the advantage of allowing ready replacement in case of breakage or wear.

The edges of the framed article in FIG. 6 are finished by plastic frame portions 51 which extend between the corner member giving the appearance that the frame is continuous. The frame portions 51 extend into recesses 53 formed in the corner members with the fit sufficiently snug to hold frame portions 51 in place. Frame portions 51 are also made of thin plastic material and are initially provided in extra long lengths capable of being cut down to the required dimension.

Rather than frame portions 51, plastic coated cloth tape (not shown) may be extended between the corner members 3W in order to finish off the frame edges intermediate the corner members.

Figure 8:
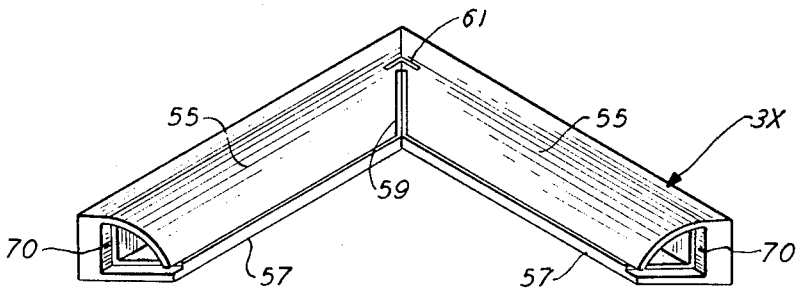
FIGS. 8 and 9 are perspective views illustrating frame member constructions in accordance with a further modification of the present invention.

Referring to FIG. 8, a modified corner member 3X is shown wherein one side wall 55 of the corner member converges toward the other side wall 57. Corner member 3X is made of a plastic material so that wall 55 is sufficiently pliable to resiliently and adjustably grasp the article to be framed. The corner member is split at corner section 59 so as to permit walls 55 to pivot. A metal insert 61 is embedded in the corner member so as to prevent the corner member from splitting in the area of split 59.

In all embodiments of the invention illustrated, stand receiving means may be provided so that the frame is capable of self support. It is preferred that each of the corner members include stand receiving means so that the frame can be supported on end or on its side.

Figure 9:
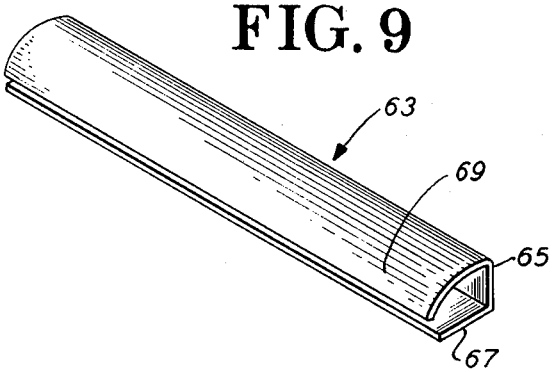

When using corner members as illustrated in FIG. 8, frame portions 63, similar in function to frame portion 51 shown in FIG. 6 and above described, may be provided to extend between the corner members so as to give the impression that the frame is continuous. As shown in FIG. 9, frame portions 63 are made of pliable plastic and comprise a base wall 65, sidewall 67 and an opposed sidewall 69 converging toward sidewall 67 so as to resiliently and adjustably grasp the article to be framed. The frame portions 63 are received in recess 70 formed in corner member 3X so as to give the frame a continuous appearance.

Figure 7:
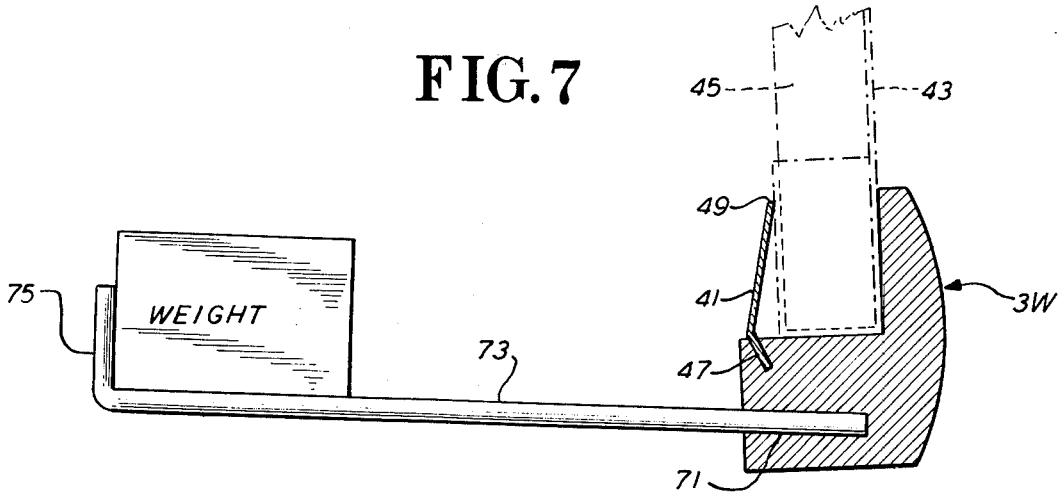
FIG. 7 is a sectional view taken on line VII—VII of FIG. 6.

The stand receiving means comprise angled bores 71 which are adapted to receive L-shaped rod stands 73 as illustrated in FIG. 7. It will be noted that the stand rods 73 extend substantially adjacent to the surfaces on which the frame is supported due to the angle of bore 71. This permits a weight to be rested on the stand and effectively hold the same when the occasion demands. One leg 75 of the L-shaped rod stand 73 prevents the weight from falling off the stand.

Figure 10:
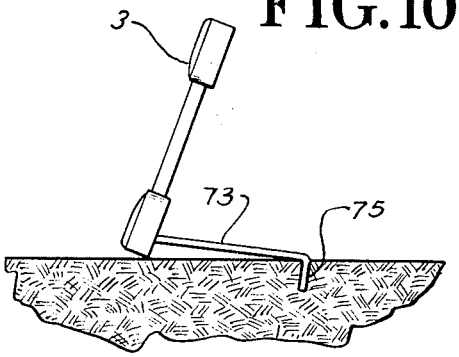
FIGS. 10 and 11 are elevational views illustrating alternative stand arrangements when the stand is anchored to the ground.
Figure 11:
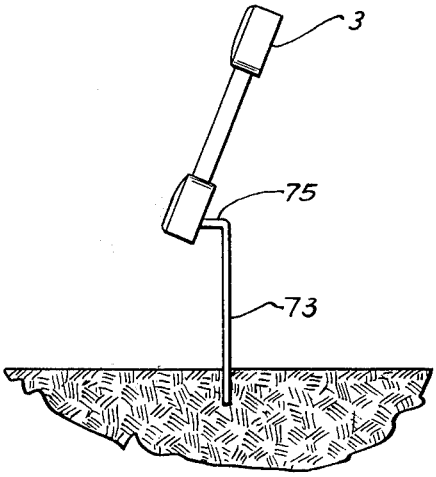

The L-shaped rod stand 73 permits alternate stand arrangements. As shown in FIG. 10, the short leg 75 is rotated 180° so as to permit the short leg to be embedded in the ground. As shown in FIG. 11, the short leg 75 is inserted in bore 71 and the long leg is embedded in the ground so as to support the frame in the elevated position.

As hereinbefore described, the cross braces have been described as flexible members so as to allow the same to be easily cut down or bent back. In storage and transportation applications, ease in cutting may not be a requirement and the cross braces could be made rigid extending across both the front and rear faces of the framed article as shown at 77 and 79 in FIG. 12 to provide double structural support. In this instance, the extra lengths of cross brace would have to be sawed off or otherwise removed by equivalent means.

Figure 13:
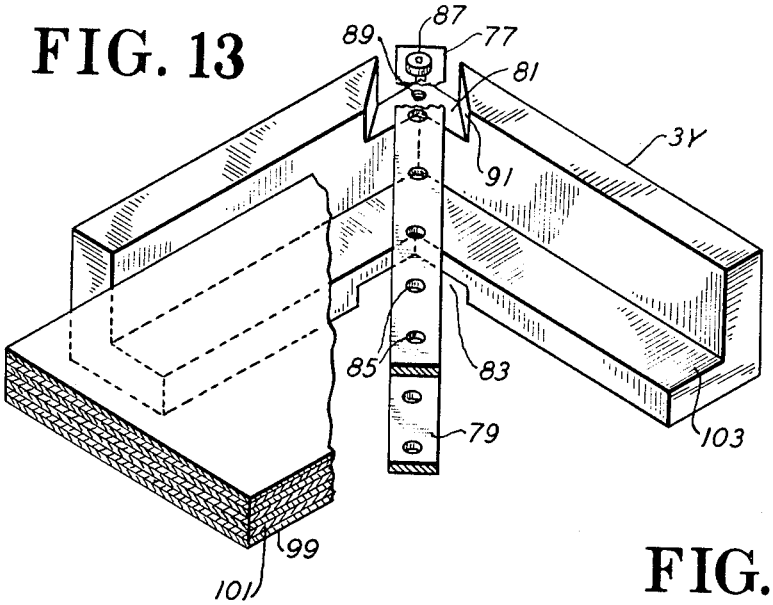
FIGS. 13 and 14 are perspective views of the corner member of the assembly in FIG. 12.
Figure 12:
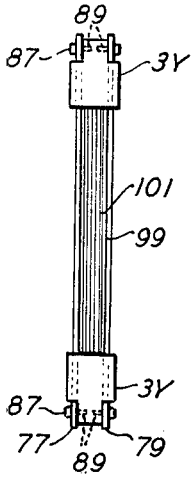
FIG. 12 is an elevational view illustrating a further embodiment of the invention.
Figure 14:
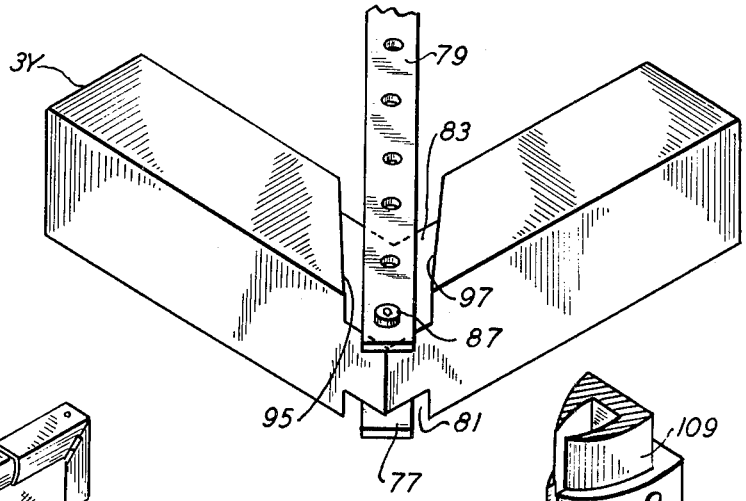

The corner member 3Y used in FIG. 12 is shown more particularly in FIGS. 13 and 14. Corner member 3Y includes opposed channels 81 and 83 for receiving cross braces 77 and 79 within the confines of the corner members so as to allow compact stacking of framed articles.

Except for their rigidity, the cross braces 77 and 79 are identical to the cross braces hereinbefore described including a plurality of apertures 85 to permit adjustment. Screw 87 extends through an aperture 85 into a threaded recess 89 in the corner member to secure the cross brace to the corner member.

Walls 91 and 93 of channels 81 and 83 and walls 95 and 97 of channel 83 diverge as they extend inwardly into the corner member. This permits the cross braces 77 and 79 to pivot to a greater extent so as to permit greater freedom in adjustment to accommodate sheets of various size.

The corner member 3Y as shown in FIG. 13 is adapted to receive sheets of material 99 and 101, one of which is the sheet being transported and the other of which is a protective intermediate and cover sheet. These sheets 99 and 101 are supported by a sheet support flange 103 on corner member 3Y and are held thereagainst by cross brace 77.

Figure 15:
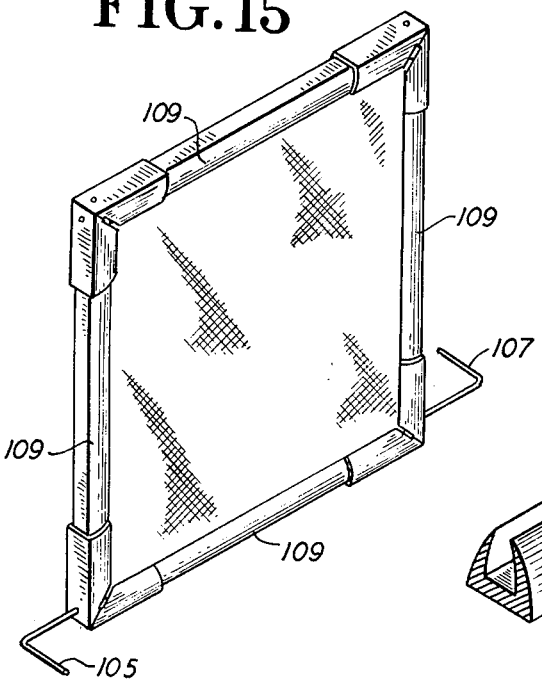
FIG. 15 is a perspective view of a further embodiment of the present invention.
Figure 16:
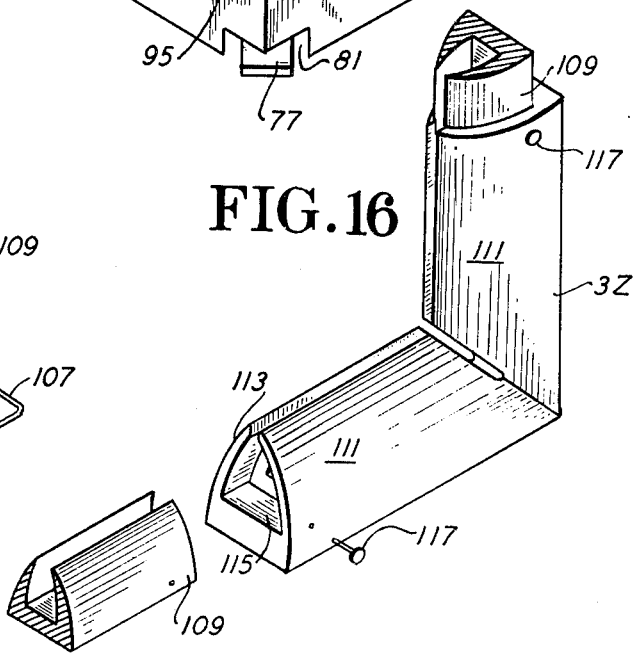
FIG. 16 is an exploded view of the corner member used in the assembly of FIG. 15.

Referring to FIGS. 15 and 16, a further modification of the present invention is shown wherein the cross braces are eliminated. In this embodiment, stands 105 and 107 are provided so as to stand the frame in a vertical position and permit viewing of pictures mounted in both sides of the frame.

Referring to FIG. 16, an exploded view of a corner member 3Z used in FIG. 15 is shown together with frame members 109. The corner member 3Z in FIG. 15 is similar to the corner member of FIG. 8 in that it is made of pliable plastic and it is adopted to be spring biased about the framed article. In this embodiment, the corner member 3Z includes two converging sidewalls 111 and 113. Frame member 109 is received in a recess 115. At the extremity wall 111 an aperture 115 is provided through which a nail 7 is hammered so as to hold the frame members 109 in place.

The invention is not necessarily limited to the exact details of construction that are shown, since various modifications may be made therein without departing from the spirit and scope of the invention as set forth in the appended claims.

What is claimed:

1. A frame comprising corner members mounted to support the corner portions of a picture, said corner members having a first inwardly curved upstanding side and a second upstanding side spaced apart from the first side by a flat section, said first and second sides being connected to opposite edges of said flat section and said first side being biased toward said second side to releasably grasp the picture and straight members having a first inwardly curved upstanding side by a flat section, said sides and said flat section having substantially the same cross-sectional configuration as said corner members and being insertable therein and mounted to support the side portions of an article being positionable between two adjacent corner members and being mounted to releasably grasp the sides of the article to form a supporting frame with said corner members, and wherein the corner members contain a slot at the corner sections to permit the parts of the corner sections to pivot.

2. The frame of claim 1 including a metal insert embedded in the corner member adjacent said slot to prevent them from splitting.

3. A frame comprising corner members mounted to support the corner portions of a picture, said corner members having a first inwardly curved upstanding side and a second upstanding side spaced apart from the first side by a flat section, said first and second sides being connected to opposite edges of said flat section and including a recess at an end of the corner member and said first side being biased toward said second side to releasably grasp the picture and straight members, said straight members having a first inwardly curved upstanding side and a second upstanding side spaced apart from said first side by a flat section, said sides and said flat section having substantially the same cross-sectional configuration as said corner members and being insertable in said recess and mounted to support the side portions of an article being positionable between two adjacent corner members and being mounted to releasably grasp the sides of the article to form a supporting frame with said corner members.

* * * * *